United States Patent [19]

Theurer et al.

[11] 3,990,154

[45] Nov. 9, 1976

[54] APPARATUS FOR MEASURING THE LATERAL DISTANCE BETWEEN ADJACENT TRACKS

[75] Inventors: Josef Theurer; Klaus Riessberger, both of Vienna, Austria

[73] Assignee: Franz Plasser Bahnbaumaschinen-Industrie-Gesellschaft m.b.H., Vienna, Austria

[22] Filed: Feb. 5, 1974

[21] Appl. No.: 440,126

[30] Foreign Application Priority Data

Apr. 9, 1973 Austria ..... 3118/73

[52] U.S. Cl. ..... 33/144; 33/1 Q; 33/338

[51] Int. Cl.[2] ..... B61K 9/08

[58] Field of Search ..... 33/144, 1 Q, 125 M, 33/141 R, 338, 146; 104/2, 8

[56] References Cited

UNITED STATES PATENTS

| | | | |
|---|---|---|---|
| 1,395,105 | 8/1921 | Harper | 33/144 |
| 1,930,395 | 10/1933 | Richter | 33/144 |
| 2,036,750 | 4/1936 | Fulbright | 33/144 |
| 2,175,655 | 10/1939 | Allen | 33/144 |
| 2,803,063 | 8/1957 | Scholtz | 33/144 X |
| 3,557,459 | 1/1971 | Plasser et al. | 33/144 |
| 3,604,359 | 9/1971 | Doorley et al. | 33/144 X |
| 3,808,693 | 5/1974 | Plasser et al. | 33/144 |

FOREIGN PATENTS OR APPLICATIONS

| | | | |
|---|---|---|---|
| 12,479 | 7/1924 | Netherlands | 104/8 |

*Primary Examiner*—Richard E. Aegerter
*Assistant Examiner*—Michael H. Thaler
*Attorney, Agent, or Firm*—Kurt Kelman

[57] ABSTRACT

In an apparatus for measuring the lateral distance between adjacent tracks, a measuring axle has a wheel which is selectively engageable without play with a selected rail of one track while a pivotal projecting arm associates therewith has laterally movable mounted thereon a rolling element for adjusting to the lateral distance between the measuring axle and the rolling element. The rolling element is arranged to sense one rail of the adjacent track as it rolls therealong, and an indicator produces a measuring signal indicating the adjusted lateral distance.

13 Claims, 5 Drawing Figures

APPARATUS FOR MEASURING THE LATERAL DISTANCE BETWEEN ADJACENT TRACKS

The present invention relates to improvements in apparatus for measuring the lateral distance between one track and an adjacent track, each track having two rails.

Known apparatus of this type comprises a measuring axle with a wheel selectively engageable without play with a selected one of the rails of the one track, and a pivotal projecting arm associated therewith whose length may be adjusted according to the lateral distance. An element for sensing one of the rails of the adjacent track cooperates with an indicator producing a measuring signal.

When such known apparatus was used in conjunction with the lining of the one track in relation to the adjacent track, various lining methods have been proposed. For instance, the track lining tool of a mobile track liner on the one track may be controlled by a reference system whose end point lying in an uncorrected track section may be determined in respect of fixed points defined by the adjacent track. To assure the accuracy of the end points along a grade rail, a rail sensing element which produces the base of the reference system is brought into engagement without play with the grade rail by magnetic means (see U.S. Pat. No. 3,629,583).

It has also been proposed to control the lining manually or by means of complicated mechanical transmission systems.

It is the primary object of this invention to overcome various difficulties and shortcomings of known apparatus of this general type and to provide such an apparatus which is not only exceedingly accurate in producing a measuring signal responsive to the lateral position of the adjacent track but also enables the measurement and/or lining to proceed truly continuously.

This and other objects are accomplished in accordance with the invention by laterally movably mounting a rolling element on the pivotal projecting arm for adjusting to the lateral distance between the measuring axle and the rolling element. The rolling element is a solid head with at least one roller arranged for sensing one of the rails of the adjacent track as it rolls therealong.

The arrangement of the solid head with a roller for sensing the lateral position of the adjacent track produces an accurate guidance without play along the track rail and advantageously attains utmost accuracy over a long time since the roller undergoes little, if any, wear as it rolls along the track rail while readily moving over rail abutments and the like. The roller can neither by retained nor moved out of position. The lateral adjustability of the rolling element, for instance by mounting it telescopingly on an outer end of the projecting arm, avoids measuring errors to the largest extent possible, this errorless action being further assured, if desired, by providing means for pressing the rolling element into engagement with the track rail.

The above and other objects, advantages and features of the invention will become more apparent from the following detailed description of certain now preferred embodiments thereof, taken in conjunction with the accompanying drawing wherein FIG. 1 is a partly schematic side view of an apparatus for measuring the lateral distance between two adjacent tracks and a control for lining one track in relation to the adjacent track, the apparatus being shown in section;

Figure 1:
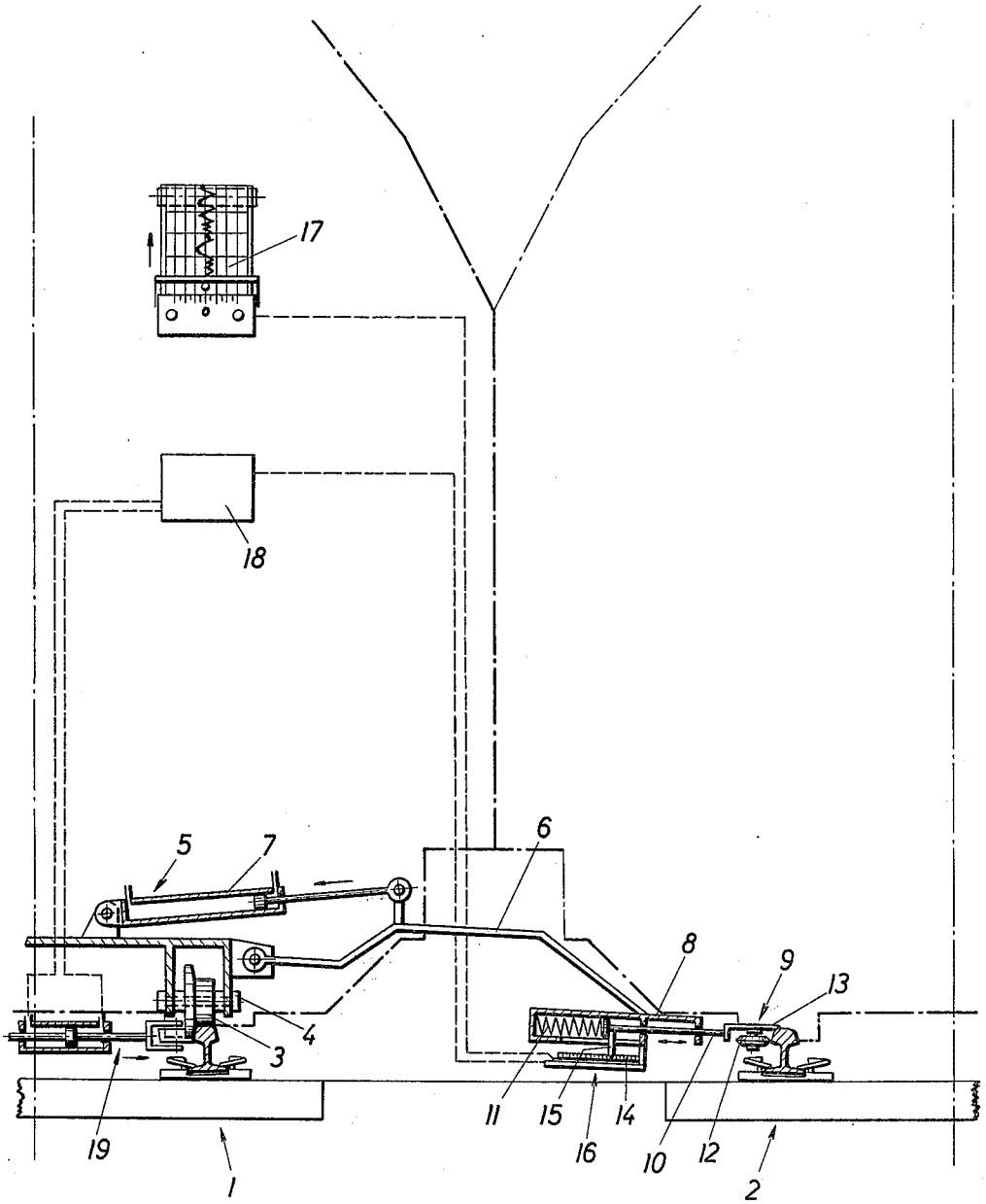

Referring now to the drawing, FIG. 1 shows parts of one track 1 and of track 2 adjacent thereto, each track consisting of two rails supported on ties. As conventional, the rails have heads with flanks to be engaged by the rail sensing rollers of the present invention, as will be more fully explained hereinafter. The frame of track survey or measuring bogie 5 is mounted for mobility on the one track 1 by means of flanged wheels 3, the bogie being guided without play along the selected grade rail by pressing the flange of wheel 3 against the flank of the grade rail head. Track survey or measuring axle 4 supports the wheel on the bogie frame. Projecting arm or jib 6 is associated with the measuring axle, the arm being mounted pivotally on the bogie frame in the illustrated embodiment for pivoting about an axis extending in the direction of track 1. Arm 6 projects towards adjacent track 2 and may be pivoted in a vertical plane transverse to the track by means of pressure fluid-operated jack 7 linked respectively to the bogie frame and arm 6.

The outer end of projecting arm 6 at adjacent track 2 carries guide member 8 wherein rod 10 is laterally movably mounted, the rod being telescopingly guided in the guide member for moving rolling element 9, which is mounted on rod 10, in a direction transverse to the tracks for adjusting it to the lateral distance between the measuring axle and the rolling element. The rolling element comprises a solid head carrying a roller for sensing one rail of track 2. The roller is pressed into engagement with the one track rail by resilient means, the illustrated resilient means consisting of compression spring 11 arranged between guide member 8 and an abutment at the inner end of rod 10. Obviously, the spring could be replaced by any equivalent pressure means, such as a pneumatic or hydraulic jack.

As shown, rolling element 9 of the embodiment of FIG. 1 comprises roller 12 in rolling engagement with the outer flank of the rail head of the one rail or track 2, the roller being mounted for rotation about an axis substantially vertical to the track and being pressed into engagement with the outer rail head flank by spring 11. This arrangement of the rotational axis of the roller and the power-actuated pressure of the roller against the side of the rail head enables the rail sensing roller to remain in accurate and secure engagement with the rail in tangent and curved track sections as well as at points where the rail has burrs or other irregularities.

Pivotal projecting arm 6 and its rail sensing roller 12 will be properly guided in a vertical direction by guide plate 13 which may be constituted by a metal sheet extending above roller 12 and therebeyond to glide along the top of the rail head. This guidance system makes it unnecessary to control the vertical position of the rail sensing roller manually since the guide plate cooperates with the roller and the one rail for positioning the roller in engaged relationship with the one rail. At the same time, the entire rail sensing arrangement, including the sensing roller and the guide plate, are positioned outside the operative portion of track 2 so that regular train traffic may continue thereover while the survey operations proceed.

The measured lateral distance between tracks 1 and 2 is indicated by an indicator which comprises scale 14 affixed to guide member 8 and pointer 15 affixed to rod 10 and cooperating with the scale to produce a measuring signal which either visibly shows the adjusted lateral distance sensed by roller 12 and/or produces an electrical measuring signal corresponding to the sensed track spacing. In the illustrated embodiment, scale 14 and pointer 15 constitute slide resistance 16 which produces and transmits an electrical measuring signal in response to the adjusted lateral distance between the tracks. The signal is transmitted by electrical conductors to recording instrument 17 which produces a written record or curve of the measured values and to control 18.

In the illustrated embodiment, the entire survey apparatus is part of a track liner whose frame is mounted for mobility on track 1 and whereon conventional track lining tool 19 is mounted. As is well known, such a track lining tool comprises power means for laterally moving the track lining tool against the selected rail of the track whereby this selected grade rail is correspondingly moved for lining it, the illustrated power means being a hydraulic jackwhich presses a rail engaging roller against the grade rail. Control 18 is connected to the hydraulic jack and to indicator 16 for actuating the jack in response to the measuring signal for lining track 1. jack which To simplify the drawing, the track liner frame, whereon the track lining tool 19, recording instrument 17 and control 18 are mounted, is not illustrated in FIG. 1 since such track liners are well known and form no part of the invention, the measuring bogie 5 with its measuring axle 4 being connected to the track liner frame in a well known manner (also not illustrated) for common movement with the track liner along the track. If desired, the measuring bogie and its axle 4 may be constituted by the undercarriage of a mobile track liner.

As indicated by the dash-dotted lines in FIG. 1, the survey apparatus, including jib 6 and rolling element 9, are outside the operative space of adjacent track 2 so that train traffic may continue throughout the survey operation on track 2. When the survey apparatus is moved to another working site, jib 6 may be pivoted back into the operative space of track 1 by means of jack 7.

Figure 2:
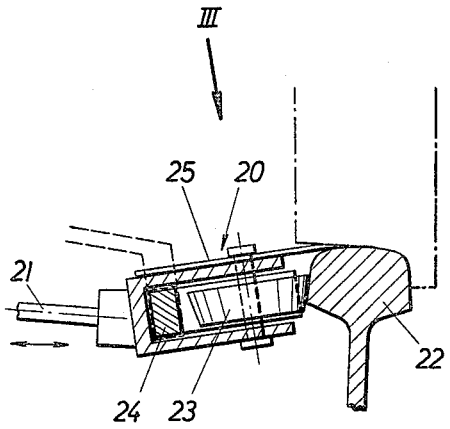
FIG. 2 shows one embodiment of a roller head with a solenoid in front elevation, partly in section.
Figure 3:
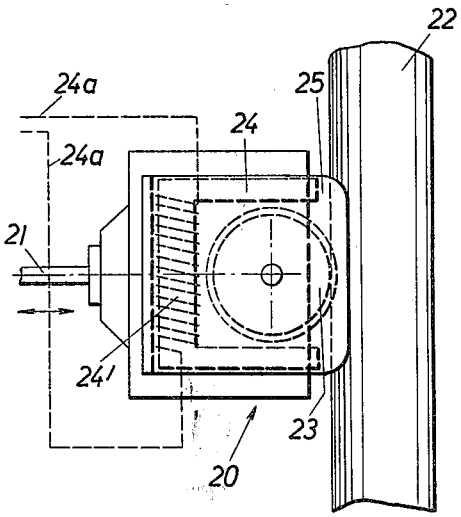
FIG. 3 is a top view of FIG. 2 in the direction of arrow III.

FIGS. 2 and 3 illustrate one specific embodiment of a rolling element useful in the practice of this invention. In this embodiment rolling element 20 comprises a head mounted on laterally movable rod 21 on the projecting arm and carrying rail sensing roller 23. The rolling element head extends upwardly from slidable rod 21 and encloses an obtuse angle therewith so that the rotary axis of roller 23 is somewhat inclined in a direction opposite to the inclination of rail 22 towards the center of the track. Satisfactory engagement of the sensing roller 23 with the outer flank of head of rail 22 is assured by forming roller 23 frusto-conically so that its rolling surface runs parallel to the rail head flank in the manner shown in FIG. 2, the conus angle of roller 22 and the flank of the rail head enclosing identical angles with the track plane so that the rolling surface of the roller is in full engagement with the flank of the rail head.

In the embodiments of FIGS. 2 to 5, magnetic means is associated with the rolling element to cause the rolling element to engage the one rail of the adjacent track. This assures an even and controlled engagement of the sensing roller with the sensed rail, the magnetic means exerting a controlled and even pressure on the roller in the direction of the steel rail, to which the magnet is attracted, so that the position of the rail will be accurately and dependably measured. Furthermore, the magnetic means provides a second support for projecting arm or jib 6 which assures a better weight distribution along the arm and provides a more sensitive vertical guide of the arm during the survey operation. Thus, the combination of magnetic means with the rolling element assures not only a substantially frictionless guide but a full engagement of the sensing roller with the sensed rail whereby the accuracy of the survey is further improved.

In the embodiment of FIGS. 2 and 3, the magnetic means is a U-shaped solenoid 24 which encompasses roller 23, i.e. the two parallel legs of the solenoid extend towards rail 22 while roller 23 is positioned therebetween. The solenoid coil 24' may be energized by conductor **24*a*** connected to a suitable power source (not shown). The ends of the solenoid legs define an air gap with the adjacent side of the rail head to assure a satisfactory functioning of the apparatus.

The use of solenoids is particularly useful if several survey devices according to this invention are used since this enables a simple and central control of the engagement of all rollers with the surveyed rail. Furthermore, U-shaped magnets assure the engagement of the sensing roller with the rail head even at points where a gap occurs between two abutting rail section ends since at least one leg of the U-shaped magnet will hold the rolling element against the rail.

As shown in FIG. 2, rolling element 20 remains entirely outside the working space of the track (indicated by dash-dotted lines) during the survey operation because of the inclination thereof in respect of the track plane.

The vertical guidance of the sensing roller along the track rail is assured by guide plate 25 constituted by a metal sheet in contact with the rounded top edge of the rail head. The guide plate may be replaced by being mounted readily removably on rolling element 20.

It will be advantageous to provide, in addition to solenoid 24, a resilient means, such as shown at 11 in FIG. 1, to press the rolling element against rail 22 so that full engagement of the roller with the rail head is assured even where the solenoid may not function for a short period of time, for instance because of dirt accumulated on the rail or an excessively large gap between abutting rail sections.

Figure 4:
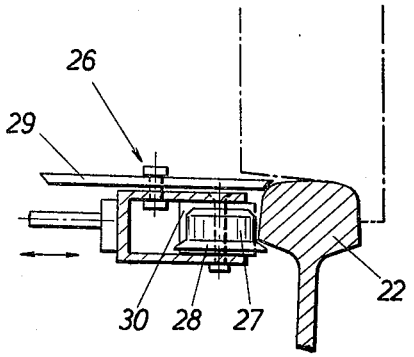
FIG. 4 illustrates another embodiment of a roller head with a permanent magnet in front elevation, partly in section.
Figure 5:
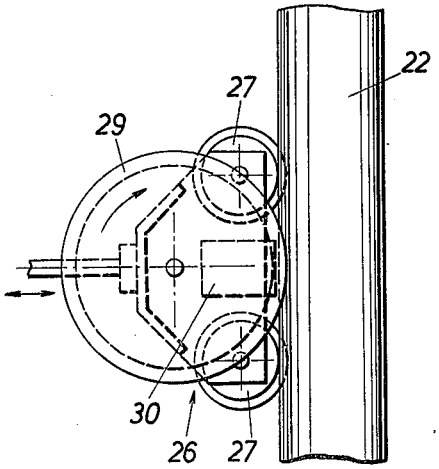
FIG. 5 is a top view of FIG. 4.

A very simple and economical embodiment of a rolling element is illustrated in FIGS. 4 and 5. In this embodiment, rolling element 26 comprises two rollers 27 spaced apart along rail 22 in the direction of track elongation and in rolling engagement with the flank or side of the rail head. The magnetic means is a permanent magnet 30 mounted between rollers 27. This arrangement has the advantage of requiring no control circuit for energizing the magnetic means and assures an even and uniform attraction of the rolling element to the adjacent steel rail at all times.

Rollers 27 are mounted for rotation about axes substantially vertical to the track plane and have flanges 28 subtending the rail head. Such flanged rollers facilitate the vertical guidance of the rollers during the survey operation and, if desired, the rollers may have two flanges for gripping the rail head therebetween. In the illustrated embodiment, rotatable disc 29 is mounted on the rolling element for rotation about an axis parallel to the rotary axes of rollers 27 for contact with the rounded to edge of the rail head in the same manner as guide plate 25 of FIG. 2.

In this embodiment, too, an air gap is left between the magnet and the rail head to assure proper functioning of the device and, if desired, a resilient means may also be used therein additionally for pressing the rolling element against the rail head.

As described in connection with FIG. 1, the survey apparatus of the present invention may be used to control track lining by means of the measuring signal produced by the survey, such measuring signals being produced, for instance, by an indicator including a rotary coil, a potentiometer or any other suitable means for producing an electrical signal corresponding to the measured distance between the two tracks.

However, this survey apparatus, with its rail sensing roller supported on a jib, may also be used to survey the distance of the end points of a conventional reference system from the adjacent track, such systems being used to line the one track in relation to the adjacent track and including, for instance, reference lines consisting of a light or infrared beam, a laser beam, a tensioned wire or an optical line of sighting. The surveyed lateral distances may then be used to control lateral movement of the end points of the reference line for properly positioning the reference line for the lining operation.

While the present invention has been described and illustrated in connection with certain now preferred embodiments, it will be understood that many variations and modifications will occur to those skilled in the art without departing from the scope and spirit of this invention as defined in the appended claims.

We claim:

1. An apparatus for measuring the lateral distance between one track and an adjacent track, each track having two rails and each rail including a head with an inner and outer flank, comprising 1. a measuring bogie adapted to be mounted on the two rails of one track and movable therealong,
   a. the measuring bogie carrying a wheel selectively engageable without play with the inner flank of the head of a selected one of the rails of the one said track,
2. a pivotal arm projecting from the measuring bogie towards an adjacent track,
3. a rolling element mounted for longitudinal movement on the projecting arm for adjusting the distance between the said wheel carried by the said measuring bogie and the rolling element, a. the rolling element being arranged for sensing only the outer flank of the head of one of the rails of the adjacent track as it rolls therealong and the rolling element being positioned outside the operative portion of the adjacent track to permit train traffic to continue thereover while the rolling element rolls along the one rail, and
4. an indicator producing a measuring signal indicating the adjusted distance.

2. The apparatus of claim 1, wherein the rolling element is telescopingly mounted on an outer end of the projecting arm.

3. The apparatus of claim 1, wherein the rolling element comprises at least one roller in rolling engagement with the outer flank of the rail head of the one rail of the adjacent track, the roller being mounted for rotation about an axis substantially vertical to the track.

4. The apparatus of claim 1, further comprising magnetic means associated with the rolling element to cause the rolling element to engage the one rail of the adjacent track.

5. The apparatus of claim 4, wherein the magnetic means comprises a permanent magnet.

6. The apparatus of claim 4, wherein the magnetic means comprises a solenoid.

7. The apparatus of claim 4, wherein the rolling element comprises a roller in rolling engagement with the outer flank of the rail head of the one rail of the adjacent track, and the magnetic means is substantially U-shaped and encompasses the roller.

8. The apparatus of claim 4, wherein the rolling element comprises two rollers spaced apart along the one rail of the adjacent track and in rolling engagement with the outer flank of the rail head of the one rail, and the magnetic means is a permanent magnet mounted between the rollers.

9. The apparatus of claim 1, further comprising resilient means mounted for pressing the rolling element into engagement with the one rail of the adjacent track.

10. The apparatus of claim 1, wherein the rolling element comprises at least one flanged roller.

11. The apparatus of claim 1, wherein the rolling element comprises at least one roller in rolling engagement with the outer flank of the rail head of the one rail of the adjacent track, and further comprising a guide plate cooperating with the roller and the one rail for positioning the roller in engaged relationship with the one rail.

12. The apparatus of claim 1, wherein the indicator comprises a scale and a pointer cooperating with the scale to produce the measuring signal, and further comprising a rod laterally movable with the rolling element, the rod carrying the pointer.

13. The apparatus of claim 12, wherein the cooperating scale and pointer of the indicator are arranged to produce an electrical measuring signal, and further comprising a recording instrument receiving the electrical measuring signal and producing a written record in response thereto.

* * * * *